United States Patent [19]

Akcelrod et al.

[11] Patent Number: 4,922,892

[45] Date of Patent: May 8, 1990

[54] APPARATUS FOR RESISTIVE EXTENSION AND FLEXION OF THE LEG

[75] Inventors: Patrick Akcelrod, Sens; Bernard Papailhau, Vire, both of France

[73] Assignee: Etablissements Tasserit, Gron, France

[21] Appl. No.: 265,744

[22] Filed: Nov. 1, 1988

[30] Foreign Application Priority Data

Nov. 10, 1987 [FR] France ..... 87 15527

[51] Int. Cl.[5] ..... A61H 1/02

[52] U.S. Cl. ..... 128/25 R; 272/136; 272/141; 272/116

[58] Field of Search ..... 128/25 R, 25 B, 87 R, 128/88; 272/136, 141, 142, 96, 134, 116

[56] References Cited

U.S. PATENT DOCUMENTS

| | | | |
|---|---|---|---|
| 964,898 | 7/1910 | Büdingen | 128/25 R |
| 3,620,530 | 11/1971 | Cosby | 272/142 |
| 4,111,417 | 9/1978 | Gardner | 272/136 |
| 4,229,001 | 10/1980 | Rowan | 272/142 X |
| 4,619,454 | 10/1986 | Walton | 272/136 X |
| 4,637,379 | 1/1987 | Saringer | 128/25 R |
| 4,671,257 | 6/1987 | Kaiser et al. | 128/25 R |

FOREIGN PATENT DOCUMENTS

| | | |
|---|---|---|
| 3037619 | 5/1982 | Fed. Rep. of Germany . |
| 2085118 | 12/1971 | France . |
| 2454798 | 11/1980 | France . |

*Primary Examiner*—Richard J. Apley
*Assistant Examiner*—H. Flaxman
*Attorney, Agent, or Firm*—Sughrue, Mion, Zinn, Macpeak & Seas

[57] ABSTRACT

Therapeutic exercise apparatus for the lower leg and thigh of a patient. The apparatus includes a base (1) and a carriage (2) mounted for displacement along a given direction (4). Structure exerts a reaction force against that displacement. A trough (6) holds the lower leg (7). One end of the trough is pivotally mounted to the carriage. A bracket (11) holds a first rotary shaft (12) for rotation about a first axis (13) perpendicular to the direction of displacement of said carriage. The first shaft is situated in a half-space (14) deliminted by the trough and opposite a half-space (15) containing the base. At least one retaining line (16) lies between the shaft (12) and the trough (6).

9 Claims, 1 Drawing Sheet

APPARATUS FOR RESISTIVE EXTENSION AND FLEXION OF THE LEG

The present invention relates to apparatuses for therapeutic exercises, and more particularly to apparatuses for performing isometric exercises intended to counter atrophy, e.g. of the thigh muscles, during prolonged immobilization due, for example, to an accident or to rheumatic disease.

BACKGROUND OF THE INVENTION

One of the presently known methods of performing isometric exercises consists in manually moving the limb to be treated, while performing thrusts or counter thrusts in order to force the muscles of the limb to work and thus help them return to their initial prior shape and quality. This method can give good results, however it nevertheless suffers from the major drawback of requiring action by a practitioner, e.g. a physiotherapist, whose professional qualifications are not essential for performing this work.

Devices have therefore been made which, to some extent, replace the practitioner, thereby releasing the practitioner for other tasks which are better adapted to professional competence.

The apparatus described in the document constituted by German patent application filed Oct. 4, 1980 and published under the number 3 037 619 was made for this purpose.

That apparatus comprises a carriage mounted on slideways, means for applying reaction forces to the carriage, e.g. a weight on which gravity may act, and a leg-holding trough pivotally mounted at one end about an axis perpendicular to the direction of carriage displacement. In theory, this device gives good results. However, as exercises are performed thereon, various parts constituting the apparatus rapidly take on slack unless they are of the very highest mechanical quality, and it can then happen that the trough does not move in a plane perpendicular to the axis of rotation of the patient's knee joint. As a result, when the patient exerts leg force, the trough may be deflected from said plane, thereby giving rise to twisting which is dangerous for the knee. Thus, while seeking to treat one trauma, it is possible to create others which are just as bad for the patient.

In order to avoid these drawbacks, apparatuses have been made using mechanical components of very high quality and great reliability. However, this technique causes the price of the apparatus to be so high as to make it inaccessible for many practitioners.

Apparatuses have also been made for mitigating the two above-mentioned drawbacks, for example apparatuses as described in published French patent applications numbers 2 085 118 and 2 454 798. These apparatuses are essentially constituted by a trough comprising two parts which are hinged to each other at respective ones of their ends, with their other ends being pivotally mounted either directly or indirectly to a rigid base. This design limits unwanted trough movement of the type mentioned above, but the cost price of the device is not much less since the trough now includes two elements, one for holding the lower leg and the other for holding the thigh, and also, since it requires a rigid base which is relatively long.

The object of the present invention is to provide an apparatus for therapeutic exercise which can be made using a small number of standard-quality components so as to ensure a low cost price, together with weight and bulk that are considerably less than those of prior art devices, while still providing the same high quality of care.

SUMMARY OF THE INVENTION

More precisely, the present invention provides a therapeutic exercise apparatus for the lower limb of a patient, i.e. for the lower leg and the thigh, the apparatus comprising a base, a carriage, means for mounting said carriage displaceable along a given direction relative to said base, means for exerting a reaction force against said displacement, a trough for holding the lower leg of the patient substantially between the foot and the knee of said lower limb, and means for pivotally mounting one end of said trough to said carriage, said apparatus including a bracket for holding a first rotary shaft about a first axis perpendicular to the displacement direction of said carriage, said first shaft being situated in the half-space delimited by said trough and opposite to the half-space containing said base, and at least one retaining link having a first end rotatably mounted on said first shaft and having its second end rotatably mounted on said trough by bearing means about a second axis of rotation which is parallel to the first axis of rotation.

BRIEF DESCRIPTION OF THE DRAWING

An embodiment of the invention is described by way of example with reference to the accompanying drawing, in which.

MORE DETAILED DESCRIPTION

Figure 1:
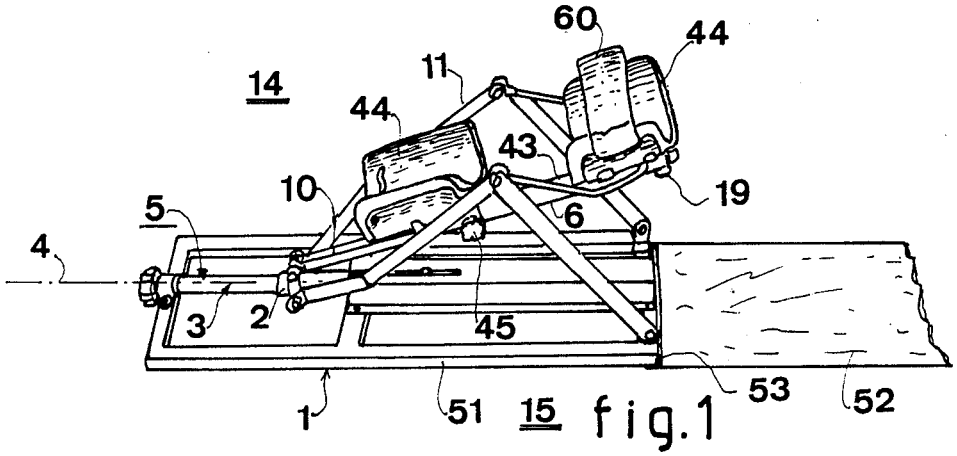
FIG. 1 is a perspective view of an embodiment of therapeutic exercise apparatus in accordance with the invention.
Figure 2:
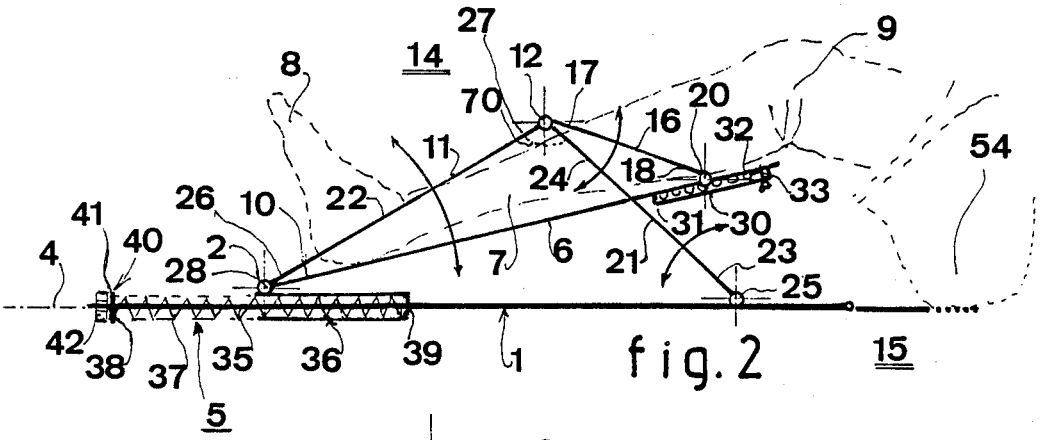
FIGS. 2 and 3 are a diagrammatic side view and a diagrammatic end view, respectively, showing the FIG. 1 embodiment and serving to explain the operation and the advantages of the apparatus.
Figure 3:
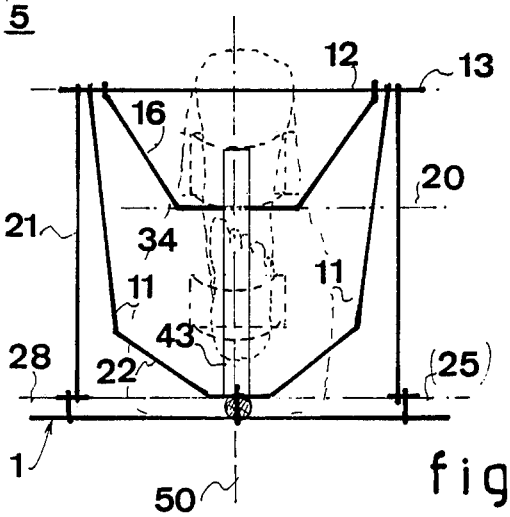

FIGS. 1 to 3 show the same embodiment of apparatus in accordance with the invention. Consequently, the same references are used therein to designate the same items regardless of the figures in which the items appear and regardless of whther the items are shown in simplified form or representationally.

The therapeutic exercise apparatus for the lower limb of a patient shown in the drawing comprises a base 1 and a carriage 2 associated with the base by means 3 in such a manner as to enable the carriage to move relative to the base in a given direction 4. The apparatus also includes means 5 for exerting a reaction force against said displacement. The direction of said reaction force is a function of the way in which the therapeutic exercise needs to be performed.

The apparatus also includes a trough 6 for holding the lower leg 7 of the patient, substantially between the foot 8 and the knee 9. It also includes means for pivoting the end 10 of the trough to the carriage 2.

According to a characteristic of the invention, the apparatus includes a bracket 11 supporting a first rotary shaft 12 lying along a first axis 13 perpendicular to the direction 4 of carriage displacement. The shaft 12 is situated in the half-space 14 delimited by the trough 6 and opposite to the half-base 15 containing the base 1. The apparatus also includes at least one link 16 having a first end 17 mounted on the shaft 12 and having its second end 18 pivotally mounted to the trough 6 by bearing means 19 about a second axis of rotation 20, said axis 20 being parallel to the above-defined first axis 13.

In a preferred embodiment, the bearing means 19 are constituted, for example, by a plurality of bearings 30 defining a plurality of positions on the trough 6 for the second axis of rotation 20. The set of bearings 30 is constituted by a rack 31 pivotally mounted on the trough 6 and defining a plurality of notches 32, 33, . . . , suitable for receiving a second shaft 34 fixed to the end 18 of the link, and for enabling it to rotate about the axis 20.

The support bracket 11 advantageously comprises a first strut 21 pivotally mounted to a second strut 22 about the first axis of rotation 13, and advantageously on the rotary shaft 12. The end 23 of the first strut 21 which is furthest from its end 24 that is pivotally mounted to the second strut 22 is pivotally mounted about a third axis 25 parallel to the first and second axes 13 and 20, said third axis being connected to the base 1. Further, the end 26 of the second strut 22 opposite to its end 27 that is pivotally mounted to the first strut 21, is pivotally mounted about a fourth axis 28 which is parallel to the axes 13, 12, and 25, and which is connected to the carriage.

As described above, the carriage 2 is mounted to move along the direction 4 relative to the base. The means enabling such displacement comprise a slideways 35 fixed to the base 1 and extending along the direction 4, and a ring 36 which is slidably mounted on the slideway, with the carriage 2 being fixed to said ring.

In the embodiment shown, the means 5 for exerting a reaction force comprise a spring 37 extending under compression between a point 38 on the base 1 and a point 39 on the ring 36. In order to allow patients to perform exercises adapted to their needs, the apparatus includes means 40 for adjusting the compression of the spring. These means are constituted, for example, by a washer 41 which is slidably mounted on the slideway 35, and a nut 42 which co-operates with a threaded portion of the slideway. By rotating the nut in one direction or the other, the patient can increase or reduce the length of the spring between the two points 38 and 39.

The above-mentioned trough 6 comprises, for example, a riser 43 fixed to the carriage, at least one leg-receiving cradle 44, and adjustable means 45 for mounting the cradle on the riser 43, and for adjusting its position along said riser.

One of the qualities of the structure of the apparatus as described above is to confer a high degree of rigidity to the apparatus in spite of the fact that most of its components are pivotally mounted relative to each other.

To this end, the apparatus includes two pairs of first and second struts and two links, with the struts and the links being substantially symmetrical about a plane 50 passing through the slideway 35 and extending perpendicularly to the first rotary shaft 12, with the two links 16 being interconnected on a common shaft 34. This configuration can clearly be seen in FIG. 3.

Since the various struts and links are in pairs, they form quadrilaterals which are pivoted, for the most part, at their vertices, thereby making it possible, in known manner, to maintain a degree of rigidity in a plane, and in particular the plane 50, even after the device has been used repetitively on numerous occasions, and even if the axes of rotation are embodied by components of ordinary manufacturing quality for the purpose of reducing the total cost price of the apparatus.

The short length of the trough 6 as described above makes it possible for the base 1 to be advantageously constituted in two parts 51 and 52. A first part 51 is made of a rigid material, e.g. in the form of a tubular metal frame supporting the third axis 25 and the means 3 for mounting the carriage movable along the direction 4. The second part 52 is made of flexible material and is fixed to the first part 51, for example by means of a hinge 53 or the like, and its length is such as to enable a patient 54 to sit thereon while one of the patient's legs 7 is engaged in the trough 6.

The above-described apparatus is used as follows, for example when exercising a thigh muscle. While the patient is sitting on the second flexible part 52 of the base 1, the operation begins by placing the leg 7 in the cradles 44 and by securing it therein firmly, for example by means of straps 60.

In order to rebuild the thigh muscles, the patient extends the lower leg against the force exerted by the spring which is previously compression by means of the knurled nut 42 to a suitable value as determined by the practitioner.

Under these conditions, as the leg is extended, the first strut 21 pivots about the axis 25 (FIG. 2) in an anticlockwise direction with the carriage 2 moving along the direction 4 and compressing the spring 37 given that the spring is held between the ring 41 and the base 1. Under such conditions, the second strut 22 rotates clockwise about the axis 27, with the apex angle 70 of the triangle constituted by the two struts 21 and 22 increasing. During this movement, the link 16 is also caused to rotate counterclockwise about the axis 13 while remaining accurately held in the midplane 50 by virtue of the structure of the apparatus, and in particular by virtue of the fact that the struts and the links are in pairs and are substantially symmetrical about said plane. There is thus no transverse force applied to the knee and the risk of trauma as mentioned in the introduction is eliminated.

After elongating the lower limb, the patient relaxes and the limb returns to the position in which it is bent by the effect of the compression spring 37 relaxing. It should be observed that when the limb is extended, the force indirectly applied on the rigid part of the base 1 is compensated by the fact that the patient is sitting on the flexible part 52 and thus contributing to applying a reaction force which keeps the base 1 in a stable position relative to the patient's body.

The angle between the lower leg and the thigh of the patient in the rest position, as shown in FIGS. 2 and 3, is adjusted by means of the various notches 32, 33, . . . . By choosing a given notch and placing the shaft 34, therein, a determined angle of the trough relative to the plane of the base is obtained. Such angle value adjustment is well known per se. It consists in deforming a triangle having two sides defined by the second strut 22 and the link 16 which are of constant length and a third side which is of variable length as defined between the axis of rotation with the base 6 on the carriage 2 and the position of the axis 20 of the shaft 34 in one of the various notches of the rack.

Such apparatus has multiple advantages. Compared with prior art apparatuses providing the same therapeutic result, it occupies half the length or less. It is easier to manufacture and it may be made using standard components that do not need to be of superior quality, while nevertheless having a lifetime which is at least as long as that of equivalent products made using components of very high cost. Finally, the fact that the bracket is made of pairs of struts and links interconnected to form quadrilaterals which are articulated at their vertices makes it possible to give the apparatus sufficient rigidity for holding the leg of the patient and avoiding damaging traumatic twisting of the knee, in spite of the rotations of the various components relative to one another.

We claim:

1. Apparatus for resistive extension and flexion of the lweg comprising; a base, a carriage, means for mounting said carriage for displacement along a given direction relative to said base, means for exerting a reaction force against said displacement, a trough for holding the leg substantially between the foot and the knee, means for pivotally mounting one end of said trough to said carriage, a bracket for holding a first rotary shaft about a first axis perpendicular to the displacement direction of said carriage, said first shaft being situated on the side of said trough opposite to said base, said bracket comprising at least one first strut and at least one second strut which are pivotally mounted to each other at first ends thereof about said first axis of rotation, said first strut having a second end pivotally mounted about a second axis parallel to said first axis and connected to said base, said second strut having a second end pivotally mounted about a third axis connected to said carriage, and at least one retaining link having a first end rotatably mounted to said first shaft and having a second end rotatably mounted on said trough by bearing means about a fourth axis of rotation, parallel the first axis.

2. Apparatus according to claim 1, wherein said bearing means is constituted by a plurality of bearings defining a plurality of positions on said trough for said fourth axis of rotation.

3. Apparatus according to claim 2, wherein the plurality of bearings is constituted by a rack pivotally mounted on said trough and defining a plurality of notches suitable rotatably receiving a second rotary shaft fixed to the second end of said link.

4. Apparatus according to claim 1, wherein said means for mounting said carriage for displacement along a given direction relative to said base comprise a slideway fixed to said base and extending along said direction, a sliding ring mounted on said slideway, and said carriage being fixed to said ring.

5. Apparatus according to claim 4, wherein said means for exerting a reaction force comprise a spring tensioned between a point of said base and a point of said ring.

6. Apparatus according to claim 5, further including means for adjusting the tension of said spring.

7. Apparatus according to claim 1, wherein said trough includes a riser fixed to said carriage, a cradle for receiving said lower leg, and adjustable means for mounting said cradle on said riser.

8. Apparatus according to claim 4, further including two pairs of first and second struts and two links, said struts and links being substantially symmetrical about a plane passing through said slideway and perpendicular to said first rotary shaft.

9. Apparatus according to claim 1, wherein said base comprises two parts: a first part made of rigid material supporting said second axis and the means for displaceably mounting said carriage; and a second part of flexible material, fixed to the first part, and having a length permitting said patient to sit on said second part with one of the patient's legs engaging said trough.

* * * * *